US007785135B2

(12) United States Patent
Wu

(10) Patent No.: US 7,785,135 B2
(45) Date of Patent: Aug. 31, 2010

(54) ELECTRICAL CONNECTOR HAVING AN IMPROVED MAGNETIC MODULE

(75) Inventor: Li-Chun Wu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/319,299

(22) Filed: Jan. 5, 2009

(65) Prior Publication Data

US 2009/0176408 A1 Jul. 9, 2009

(30) Foreign Application Priority Data

Jan. 5, 2008 (CN) ..... 2008 2 0030609 U
Jan. 5, 2008 (CN) ..... 2008 2 0030610 U

(51) Int. Cl.
*H01R 3/00* (2006.01)

(52) U.S. Cl. ..... 439/490; 439/676

(58) Field of Classification Search ..... 439/490, 439/678, 620.05, 620.17, 620.21, 941
See application file for complete search history.

(56) References Cited

U.S. PATENT DOCUMENTS 5,015,981 A * 5/1991 Lint et al. ..... 336/65
5,587,884 A * 12/1996 Raman ..... 361/728
5,656,985 A * 8/1997 Lu et al. ..... 336/96
5,736,910 A * 4/1998 Townsend et al. ..... 333/181
5,872,492 A * 2/1999 Boutros ..... 333/182
6,102,741 A * 8/2000 Boutros et al. ..... 439/620.06
6,116,946 A * 9/2000 Lewis et al. ..... 439/490
6,160,485 A * 12/2000 Krakovich ..... 340/635
6,224,425 B1 * 5/2001 Shutter ..... 439/620.17
6,227,911 B1 * 5/2001 Boutros et al. ..... 439/620.18
6,425,781 B1 * 7/2002 Bernstein et al. ..... 439/490
6,554,638 B1 * 4/2003 Hess et al. ..... 439/490
6,655,988 B1 * 12/2003 Simmons et al. ..... 439/541.5
6,736,670 B2 * 5/2004 Clark et al. ..... 439/540.1
6,743,047 B2 * 6/2004 Korsunsky et al. ..... 439/540.1
6,749,467 B2 * 6/2004 Korsunsky et al. ..... 439/676
6,773,302 B2 * 8/2004 Gutierrez et al. ..... 439/541.5
6,776,651 B1 * 8/2004 Liu ..... 439/490
6,878,012 B2 * 4/2005 Gutierrez et al. ..... 439/607.26
6,916,206 B2 * 7/2005 Ferentz ..... 439/620.01
6,962,511 B2 * 11/2005 Gutierrez et al. ..... 439/676
6,986,684 B1 * 1/2006 Lien ..... 439/620.07
7,040,926 B2 * 5/2006 Ferentz ..... 439/620.21
7,040,927 B1 * 5/2006 Liu ..... 439/620.2
7,114,985 B2 * 10/2006 Doorhy et al. ..... 439/404
7,241,181 B2 * 7/2007 Machado et al. ..... 439/676

(Continued)

*Primary Examiner*—T C Patel
*Assistant Examiner*—Vladimir Imas
(74) *Attorney, Agent, or Firm*—Ming Chieh Chang; Wei Te Chung; Andrew C. Cheng

(57) ABSTRACT

An electrical connector (100) has a housing (10) defining an opening therein (101), a magnetic module (3) mounted to the housing and a shield (50) surrounding the housing. The magnetic module includes a printed circuit board (31), a first set of terminals (20) mounted to a front face of the printed circuit board and received in the opening, a second set of terminals (21) mounted to a rear side of the printed circuit board, a toroidal coil pair (32) mounted to the printed circuit board and having a first toroidal body and (321), and a second toroidal body (322) electrically connected with each other by a circuit provided on the printed circuit board.

5 Claims, 6 Drawing Sheets

U.S. PATENT DOCUMENTS 7,267,584 B1 * 9/2007 Liu ..... 439/676
7,326,084 B1 * 2/2008 Chen et al. ..... 439/620.23
7,367,851 B2 * 5/2008 Machado et al. ..... 439/676
7,393,238 B2 * 7/2008 Xuan et al. ..... 439/490
7,413,468 B1 * 8/2008 Little et al. ..... 439/490
7,458,856 B2 * 12/2008 Ferentz ..... 439/620.23
2003/0087558 A1 * 5/2003 Korsunsky et al. ..... 439/676
2004/0005820 A1 * 1/2004 Gutierrez et al. ..... 439/676
2005/0277339 A1 * 12/2005 Caveney et al. ..... 439/676
2005/0282441 A1 * 12/2005 Murr et al. ..... 439/676
2006/0030220 A1 * 2/2006 Belopolsky et al. ..... 439/676
2007/0238359 A1 * 10/2007 Gutierrez et al. ..... 439/620.01
2007/0259573 A1 * 11/2007 Machado et al. ..... 439/676
2008/0214058 A1 * 9/2008 Machado et al. ..... 439/676
2008/0233803 A1 * 9/2008 Renteria et al. ..... 439/620.15
2008/0242156 A1 * 10/2008 Caveney et al. ..... 439/676
2008/0248694 A1 * 10/2008 Togami et al. ..... 439/620.05
2008/0305692 A1 * 12/2008 Little et al. ..... 439/676

* cited by examiner

ELECTRICAL CONNECTOR HAVING AN IMPROVED MAGNETIC MODULE

BACKGROUND OF THE INVENTION

1. Field of the Invention

The present invention relates to an electrical connector, and particularly to an electrical connector having an improved magnetic module.

2. Description of Prior Arts

U.S. Pat. No. 5,736,910 issued on Apr. 7, 1998 discloses a modular jack mounted onto a mother printed circuit board and adapted for receiving a plug. The modular jack includes a housing defining a receptacle, a daughter printed circuit board attached to a rear portion of the housing, a first set of contacts mounted to the housing for engaging with the plug and a second set of contacts assembled to the printed circuit board for connecting to the mother printed circuit board. A plurality of toroidal coil pairs are interposed between the first contacts and the second contacts for eliminating high frequency noise. Each toroidal coil pair has a first toroidal body functioning as a common mode filter, a second toroidal body functioning as a transformer. The first toroidal and the second body respectively has a first and a second toroidal cores and at least a coil to wind around the first toroidal core and the second toroidal core for electrically connecting the first core and the second toroidal cores together.

In general, a first toroidal core and a second toroidal core are electrically connected with each other by a coil which is together wound around the first and the second toroidal cores by manual operation. It would result in complicating the assembly of the toroidal coil pair and increasing the cost of manufacture.

Hence, it is desirable to provide an improved electrical connector to overcome the aforementioned disadvantages.

SUMMARY OF THE INVENTION

An object of the present invention is to provide an electrical connector having a magnetic module which comprises a toroidal coil pair having a pair of toroidal bodies electrically connected with each other efficiently.

To achieve the above object, an electrical connector comprises a housing defining an opening therein, a magnetic module mounted to the housing and a shield surrounding the housing. The magnetic module has a printed circuit board, a first set of terminals mounted to a front face of the printed circuit board and received to the opening, a second set of terminals mounted to a rear side of the printed circuit board, a toroidal coil pair mounted to the printed circuit board comprising a first toroidal body and a second toroidal body electrically connected each other by a circuit of the printed circuit board.

Advantages of the present invention are to provide a toroidal coil pair having a first toroidal body and a second toroidal body respectively mounted to a printed circuit board automatically and connected with each other by a circuit provided on the printed circuit board. Therefore, it is efficient to electrically connect the first toroidal body to the second toroidal body by a circuit of the printed circuit board and reduce the cost of manufacture.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
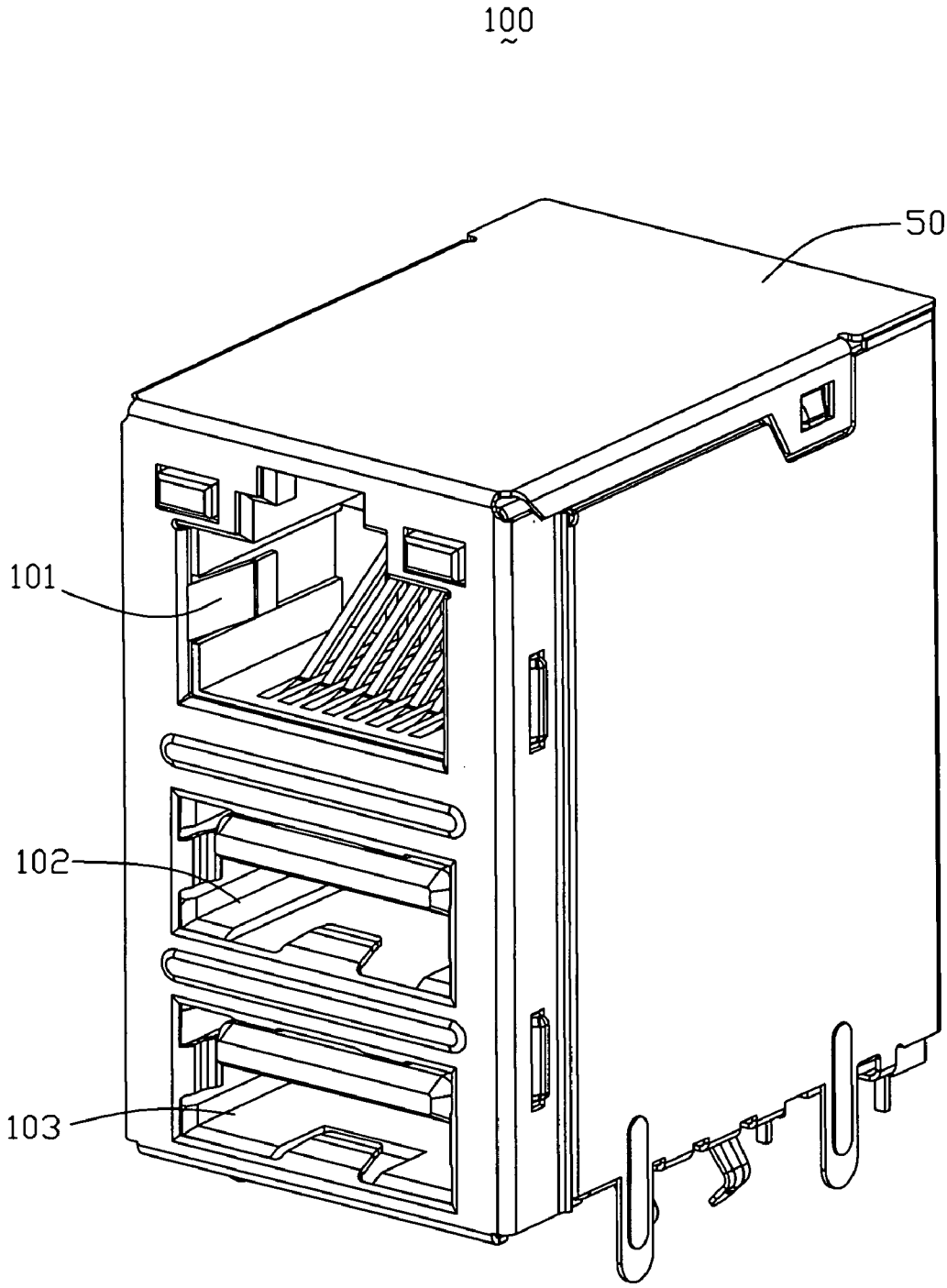
FIG. 1 is an assembled perspective view of an electrical connector.
Figure 2:
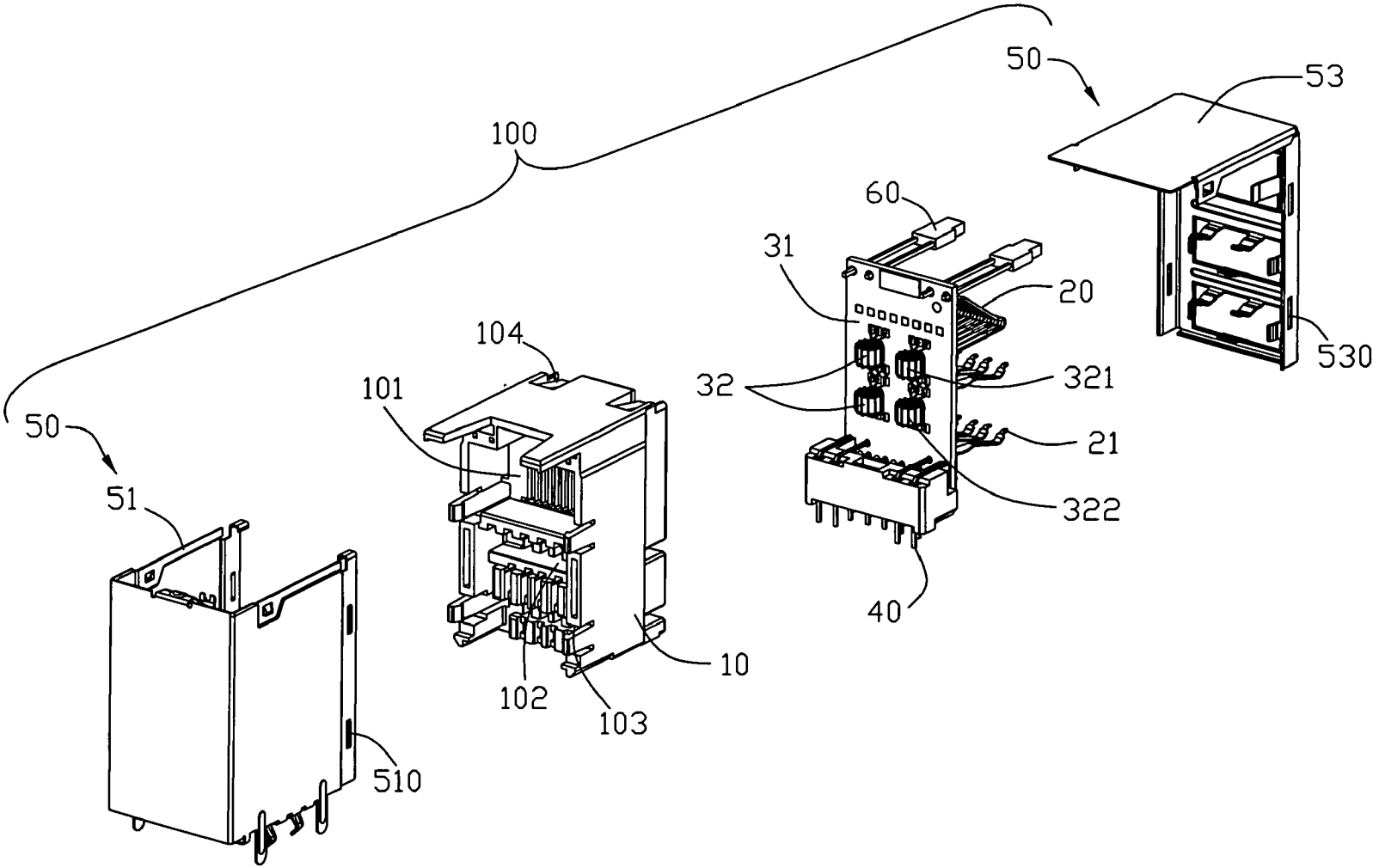
FIG. 2 is an exploded view of the electrical connector as shown in FIG. 1.
Figure 3:
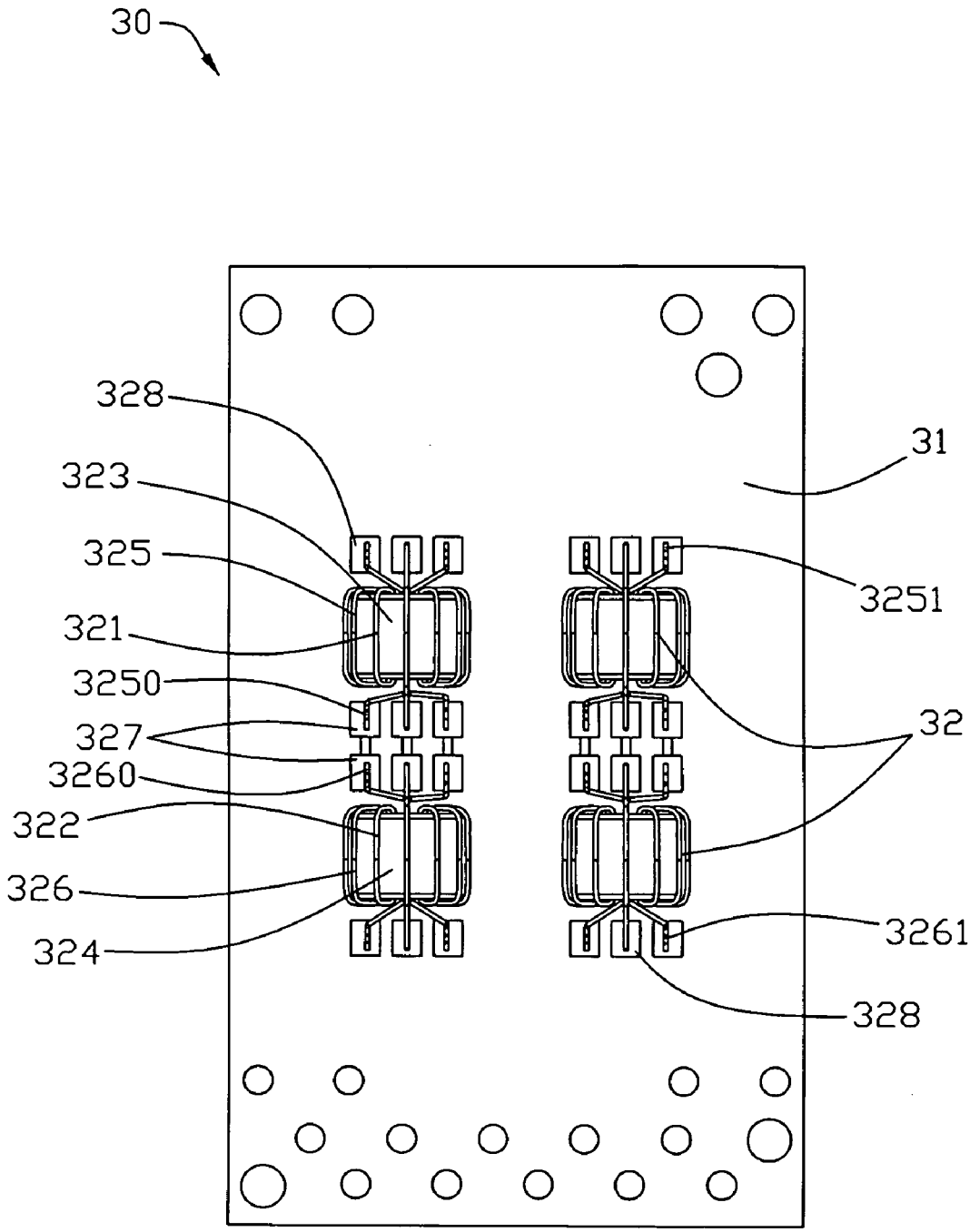
FIG. 3 is a perspective view of a magnetic module.

Reference will now be made to the drawing figures to describe the present invention in detail. Referring to FIGS. 1-3, an electrical connector 100 is commonly used in the computer or network appliance as input/output port for transmitting data or signals. The electrical connector 100 includes a housing 10 defining an opening 101 therein, a magnetic module 30 having a printed circuit board 31, and a shield 50 surrounding the housing 10.

The electrical connector 100 has a first set of terminals 20 mounted to a front face of the printed circuit board 31 and received into the opening 101, a second set of terminals 40 mounted to a rear side of the printed circuit board 31 and extending downwardly for connecting with a mother printed circuit board (not shown), and two groups of pins 21 assembled to the printed circuit board 31 and paralleled to the first set of terminals 20. The electrical connector 100 further comprises a pair of LEDs 60 (Light Emitting Diodes) retained in corresponding pipe slots 104 defined on a top portion of the housing 10. The housing 10 has two receiving spaces 102 and 103 defined therein and profiled one above of the other for respectively coupling with the group of pins 21.

Referring to FIG. 3, the magnetic module 30 is attached to a rear portion of the housing 10 and comprises two toroidal coil pairs 32 mounted to the printed circuit board 31. The toroidal coil pair 32 includes a first toroidal body 321 and a second toroidal body 322 electrically connected each other by a circuit provided on the printed circuit board 31. The first and the second toroidal bodies 321, 322 respectively comprises a first and a second toroidal cores 323, 324 which respectively has a plurality of first coils 325 wound around the first toroidal core 323 and a plurality of second coils 326 wound around the second toroidal core 324. The printed circuit board 31 comprises a plurality of first pads 327 arranged into two rows between first toroidal body 321 and the second toroidal body 322, and second pads 328 placed on the printed circuit board 31. One end of each first coils 3250 is placed onto a front row of the first pads 327 and one end of each second coil 3260 is connected onto the rear row of the first pad 327. The opposite ends of the first and the second coils 3251, 3261 are connected onto the second pads 328. The first toroidal body 321 functions as a common mode filter and a second toroidal body 322 functions as a transformer.

Referring to FIGS. 1-2, the shield 50 comprises a front shield 53 having a number of recesses 530 defined on an edge portion of the front shield 53, and a rear shield 51 having corresponding protrusions 510 for mating with the recesses 530 of the front shield 53.

Referring to FIGS. 1-3, in assembling, firstly, the number of first coils 325 wind around the first toroidal core 323 and the number of second coils 326 wind around the second toroidal core 324. The first toroidal body 321 is mounted to the printed circuit board 31 by machine. Then the second toroidal body 322 is mounted to the printed circuit board 31 by machine. One end of each first coil 3250 is soldered onto a front row of the first pads 327 and individual end of second coil 3260 is connected onto the rear row of the first pad 327, and the opposite ends of the first and the second coils 3251, 3261 are connected onto the second pads 328. Secondly, the first set of terminals 20, the second set of terminals 40 and the two groups of pins 21 are assembled to the printed circuit board 31. Thirdly, the LEDs 60 are received into the pipe slots 104. Fourthly, the magnetic module 30 is mounted to the rear portion of the housing 10. The first set of terminals 20 and the two group of pins 21 are respectively received into the opening 101 and the receiving space 102 and 103. Finally, the front shield 53 and the rear shield 51 enclose the housing 10 and are locked with each other.

Figure 4:
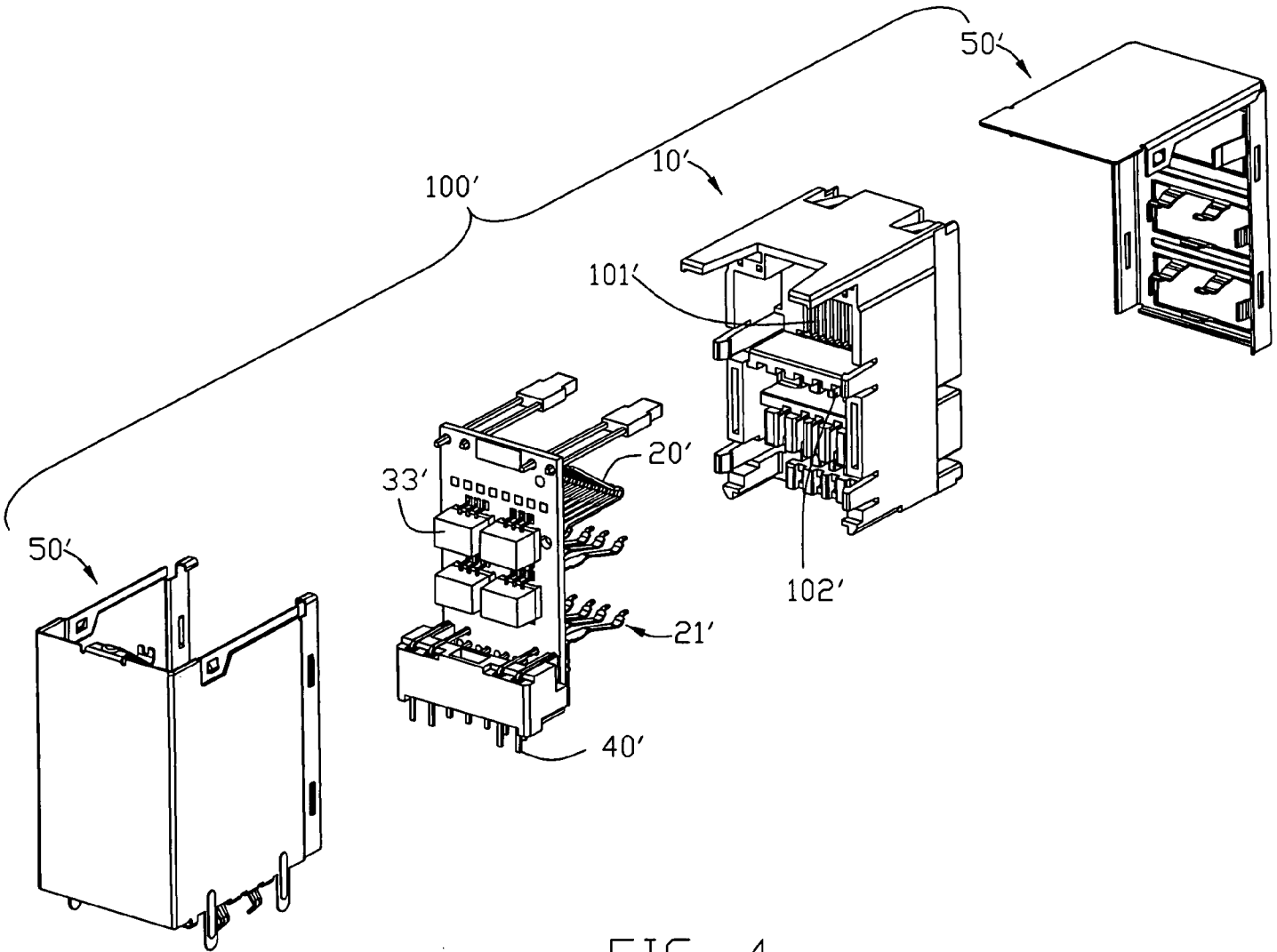
FIG. 4 is an exploded view of an electrical connector in accordance with a second embodiment.
Figure 5:
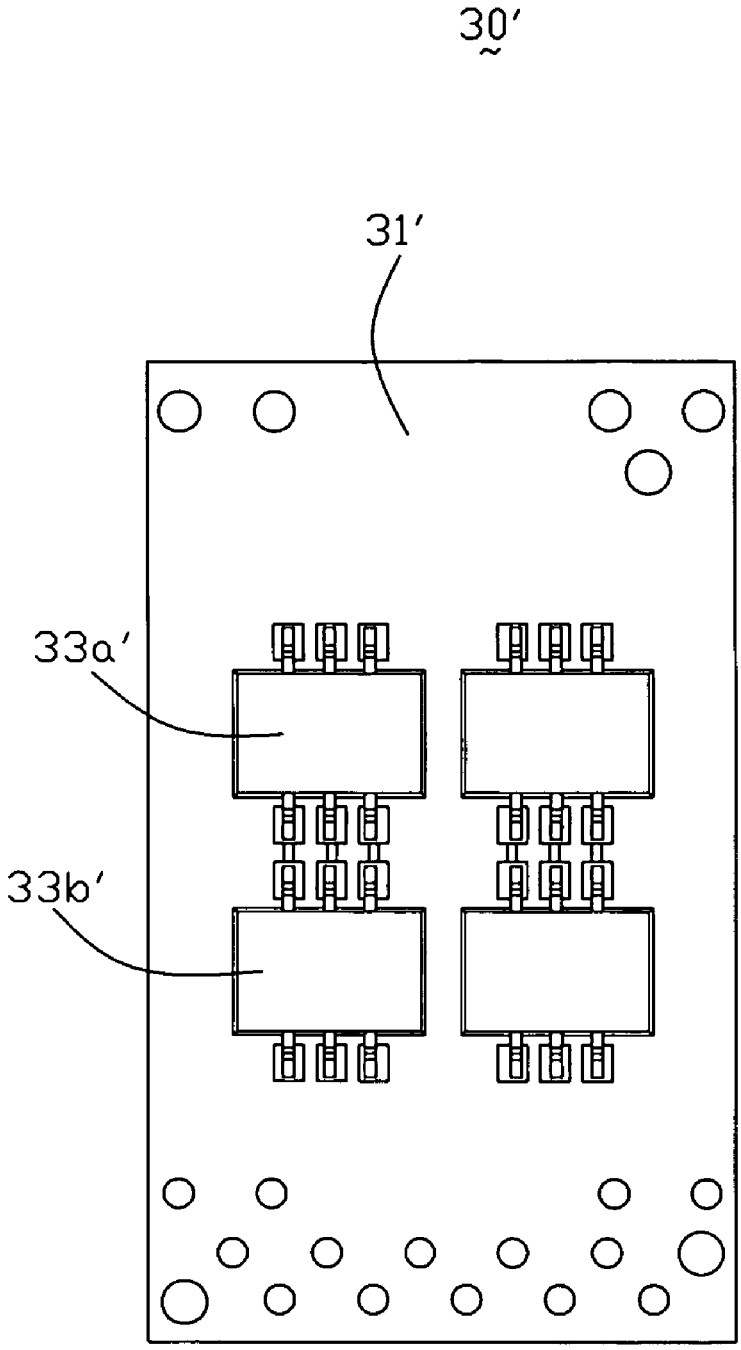
FIG. 5 is a perspective view of a magnetic module as shown in FIG. 4.
Figure 6:
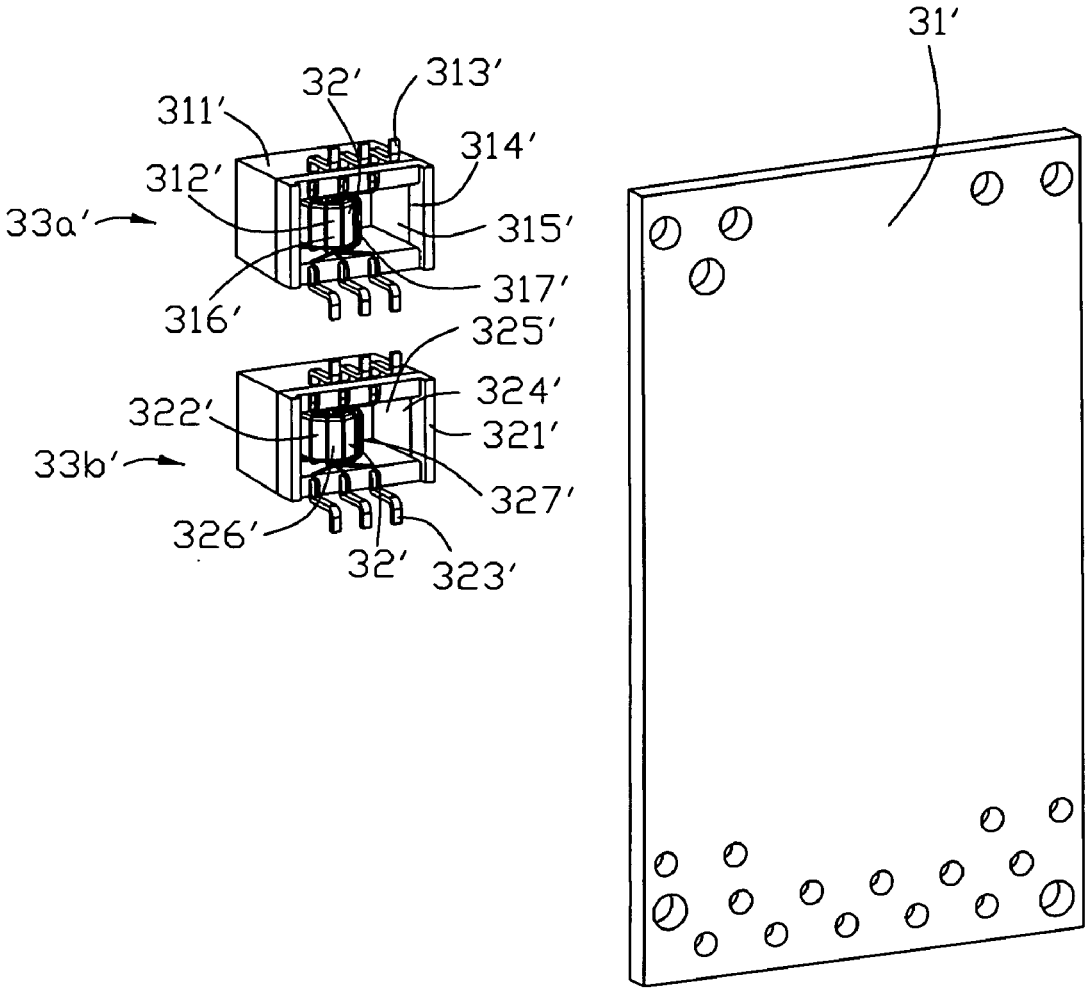
FIG. 6 is a perspective view of a magnetic module as shown in FIG. 4, taken from another aspect.

FIGS. 4-6 illustrate a second preferred embodiment of the present invention. In this embodiment, an electrical connector 100' includes a housing 10' defining an opening 101' therein, a magnetic module 30' having a printed circuit board 31', and a shield 50' surrounding the housing 10'.

The insulative housing 10' has a configuration similar to that of the first embodiment. Detailed description is not illustrated here.

Similarly, the electrical connector 100' has a first set of terminals 20', a second set of terminals 40', and two groups of pins 21' assembled to the printed circuit board 31'. Detailed description is thereby omitted.

Referring to FIGS. 5-6, the magnetic module 30' is attached to a rear portion of the housing 10' and comprises a first module 33*a*' and a second module 33*b*' mounted to the printed circuit board 31' and two toroidal coil pair 32'. The first module 33*a*' comprises a first base 311' defining a first cavity 315', a pair of opposite side walls (not labeled), and two groups of first pins 313' respectively molded into the corresponding side walls. The second module 33*b*' comprises a second base 321' defining a second cavity 325', a pair of opposite side walls (not labeled) and two groups of second pins 323' respectively molded into the side walls. The toroidal coil pair 32' includes a first toroidal body 312' functioning as a common mode filter and a second toroidal body 322' functioning as a transformer. The first toroidal body 312' is received into the first cavity 315' and has a first toroidal core 316' and a plurality of first coils 317' wound around the first toroidal core 316'. One end of the first coil 317' is soldered onto a first end portion of the pin 313' and opposite end of the first coil 317' is soldered onto a tail portion of the first pin 313' which extends outwardly from the side wall of the first base 311'. The second toroidal body 322' is received into the second cavity 325' and has a second toroidal core 326' and a plurality of second coils 327' wound around the second toroidal core 326'. One end of the second coil 317' is soldered onto a first end portion of the second pin 323' and an opposite end of the first coil 327' is soldered onto a tail portion of the second pin 323' which extends outwardly from the side wall of the second base 311'. The tail portions of the first pins 313' and the second pins 323' are assembled onto the printed circuit board 31' for electrically connecting the first module 33*a*' to the second module 33*b*' by a circuit provided on the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a housing defining an opening therein;

a magnetic module mounted to the housing and comprising:

a printed circuit board;

a toroidal coil pair mounted to the printed circuit board and comprising a first toroidal body and a second toroidal body electrically connected with each other by a circuit provided on the printed circuit board;

a first set of terminals mounted to a front face of the printed circuit board and received in the opening;

a second set of terminals mounted to a rear side of the printed circuit board; and a shield surrounding the housing, the first and the second toroidal bodies respectively comprise a first and a second toroidal cores, at least a first and a second coils wound around the first and the second toroidal cores for electrically connecting with the printed circuit board, wherein said printed circuit board comprises a plurality of first pads and second pads disposed thereon, individual ends of the first and the second coil connected onto the first pads, and the opposite ends of the first and the second coils connected onto the second pads, wherein said first pads are arranged into two rows between the first toroidal body and the second toroidal body, the end of the first coil connected to one row of the first pads and the end of the second coil connected to the other row of the first pads.

2. The electrical connector as claimed in claim 1, wherein said first toroidal coil functions as a common mode filter and the second toroidal body functions as a transformer.

3. The electrical connector as claimed in claim 1, further comprising two groups of pins assembled to the printed circuit board and paralleled to the first set of terminals.

4. The electrical connector as claimed in claim 3, wherein said housing has two receiving spaces defined therein and profiled one above the other for respectively receiving the groups of pins.

5. The electrical connector as claimed in claim 1, wherein said shield comprises a front shield and a rear shield locked with the front shield.

* * * * *